US008610296B2

(12) United States Patent
Usami et al.

(10) Patent No.: US 8,610,296 B2
(45) Date of Patent: Dec. 17, 2013

(54) STARTER ADAPTED TO ABSORB ENGINE-OSCILLATION

(75) Inventors: Shinji Usami, Okazaki (JP); Mitsuhiro Murata, Niwa-gun (JP); Masami Niimi, Handa (JP)

(73) Assignee: Denso Corporation, Kariya (JP)

( * ) Notice: Subject to any disclaimer, the term of this patent is extended or adjusted under 35 U.S.C. 154(b) by 610 days.

(21) Appl. No.: 12/732,722

(22) Filed: Mar. 26, 2010

(65) Prior Publication Data

US 2010/0251851 A1 Oct. 7, 2010

(30) Foreign Application Priority Data

Apr. 2, 2009 (JP) ..... 2009-090278

(51) Int. Cl.
*F02N 11/00* (2006.01)

(52) U.S. Cl.
USPC ..... 290/38 R

(58) Field of Classification Search
USPC ..... 290/38 R; 310/71, 179–180, 184
See application file for complete search history.

(56) References Cited

U.S. PATENT DOCUMENTS

| | | | | |
|---|---|---|---|---|
| 2,045,197 | A * | 6/1936 | Neuland | 475/152 |
| 2,482,534 | A * | 9/1949 | Antonidis | 74/7 A |
| 5,159,908 | A | 11/1992 | Eyermann et al. | |
| 5,222,401 | A * | 6/1993 | Fasola et al. | 74/7 A |
| 7,275,509 | B2 * | 10/2007 | Kassner | 123/179.25 |
| 7,545,070 | B2 * | 6/2009 | Schach et al. | 310/184 |
| 7,665,438 | B2 | 2/2010 | Hirning et al. | |
| 2005/0193840 | A1 * | 9/2005 | Murase et al. | 74/7 E |
| 2005/0280323 | A1 * | 12/2005 | Amagasa | 310/71 |
| 2008/0162007 | A1 | 7/2008 | Ishii et al. | |

FOREIGN PATENT DOCUMENTS

| | | |
|---|---|---|
| JP | A-04-501151 | 2/1992 |
| JP | A-11-30173 | 2/1999 |
| JP | A-2003-003938 | 1/2003 |
| JP | A-2007-107527 | 4/2007 |
| JP | A-2008-510099 | 4/2008 |
| JP | A 2008-163818 | 7/2008 |
| JP | A 2009-191843 | 8/2009 |

OTHER PUBLICATIONS

Dec. 21, 2012 Office Action issued in Japanese Patent Application No. 2009-090278 (with translation).

* cited by examiner

*Primary Examiner* — Jean F Duverne
(74) *Attorney, Agent, or Firm* — Oliff & Berridge, PLC

(57) ABSTRACT

A starter to start an engine mounted on a vehicle provides an electromagnetic solenoid to push a pinion gear towards a ring gear side, an electromagnetic switch to open and close a motor contact point. The electromagnetic solenoid and the electromagnetic switch are individually controlled by an Electronic Control Unit i.e., ECU. When an idle-stop is triggered, the ECU controls a starter relay to be closed during the ring gear is rotating whereby the pinion gear together with a clutch are pushed out to counter-motor direction by the electromagnetic solenoid. As a result, the pinion gear meshes with the ring gear that is rotating at lower rotational speed. Therefore, the inertial mass of the starter is added to the ring gear so that swinging of the engine can be suppressed.

5 Claims, 6 Drawing Sheets

STARTER ADAPTED TO ABSORB ENGINE-OSCILLATION

CROSS-REFERENCE TO RELATED APPLICATION

This application is related to Japanese Patent Application No. 2009-90278 filed on Apr. 2, 2009, the contents of which are hereby incorporated by reference.

BACKGROUND OF THE INVENTION

Field of the Invention

The present invention relates generally to a starter for starting an engine mounted on vehicles such as passenger cars, and more particularly to a pinion shift-type starter for starting an engine by rotational force of a motor which is transmitted by a ring gear via a pinion gear.

An increase in vehicles (referred to, hereinafter, as idle-stop vehicles) including an idle-stop apparatus that automatically controls stop and restart of an engine is expected in the next few years to reduce carbon dioxide emission and improve fuel efficiency. An idle-stop vehicle frequently encounters situations on the road such as stopping at a traffic light at an intersection, and temporarily stopping during a traffic jam and the like. In this situations, the idle-stop apparatus controls the idle-stop such that the idle-stop apparatus automatically stops the engine by cutting off the fuel supply to the engine and restarting the engine when a driver operates the vehicle to run (such as by release of the break pedal, or a shift operation to a drive range) so that a condition of restarting the engine is met, the idle-stop apparatus automatically starts the starter to restart the engine.

As shown in FIG. 1, when the idle-stop is performed, the fuel supply to the engine is cut off. Therefore, the engine rotation rate rapidly decreases and the engine rotation rate overshoots negatively (i.e., reverse rotation occurs). Subsequently, the engine rotates in forward direction and reverse direction repeatedly and the rotation frequency decreases gradually to stop the engine. While the rotation of the engine toggles the direction in the forward direction and reverse direction, the vibration caused by the engine rotation rate becomes large. Therefore, the vibration of the engine is transmitted to the vehicle and causes the vehicle-body vibration so that the driver of the vehicle may feel discomfort. Regardless of the idle-stop, this engine rotation behavior i.e., repeatedly changing the rotate direction of the engine forward from/to reverse direction (referred to swinging of the engine or engine-oscillation), occurs even when the engine is in normal stopped condition when the ignition switch is turned off. However, the idle-stop vehicles more frequently stop the engine (automatically) compared with vehicles having no idle-stop apparatus. Therefore, it is possible that the vibration of the vehicle-body caused by the engine stop condition makes the driver uncomfortable.

In contrast, Japanese Patent Laid-open Publication No. 2008-163818 states that the pinion gear can be meshed with the ring gear during inertial rotation that occurs until the engine comes to a complete stop. In this instance, because the ring gear is rotating at a low speed, the pinion gear can be meshed with the ring gear merely by being pushed toward the ring gear side, without a motor being rotated. With this feature as stated in the publication document, for example, if the pinion gear meshes with the ring gear before the occurrence of the engine-oscillation and subsequently maintains the meshing-state between the pinion gear and the ring gear until the engine rotation completely stops, the ring gear additionally receives load of the inertial mass of the starter. As a result, the overshooting of the engine can be reduced whereby period of the engine-oscillation also can be reduced.

As described above, to suppress the engine-oscillation by meshing the pinion gear with the ring gear during inertial rotation, it is necessary to stop supplying the power to the motor during that period (during the pinion gear meshing with the ring gear until the engine rotation is stopped). However, in the starter according to the above-described document, a single electromagnetic switch serves to push the pinion gear toward the ring gear side via a shift lever, and to open and close a motor contact point. In this configuration, the motor contact point closes and the rotational force is generated in the motor almost simultaneously with an end surface of the pinion gear coming into contact with an end surface of the ring gear. Therefore, it is not possible to push only the pinion gear towards the ring gear and mesh the pinion gear with the ring gear, without rotating the motor. In other words, at the point of the pinion gear meshes with the ring gear, the motor contact point is closed and the rotational force of the motor is generated. Hence, the engine-oscillation cannot be suppressed by using the inertia mass of the starter.

SUMMARY OF THE INVENTION

The present invention has been made based on the above-described issues. An object of the present invention is to provide a starter that can mesh a pinion gear with a ring gear during inertial rotation of the ring gear without using rotational force of a motor, and maintain the meshed state between the pinion gear and the ring gear whereby the engine-oscillation can be reduced.

The present invention discloses a starter to start an engine mounted on a vehicle. The starter includes: a motor that generates rotational force by supplying power supplied by a power source via a power line; an output shaft that rotates by receiving the rotational force transmitted by the motor; a pinion gear that transmits the rotational force generated by the motor to a ring gear; a pinion body being allowed to move integrally with the pinion gear in an axial direction along an outer circumference of the output shaft; an electromagnetic solenoid that generates force to push the pinion body outward in the axial direction towards the ring gear side; an electromagnetic switch for switching a motor contact point disposed in the power line, on and off to control supplying the power to the motor; and a control means configured to control the electromagnetic solenoid and the electromagnetic switch individually. The control means controls the solenoid and the switch to allow the pinion body to move in the axial direction towards the ring gear side when the engine is going to stop whereby the pinion gear meshes with the ring gear that is rotating, and controls the solenoid and the switch to hold the movement of the pinion body so as to keep the meshing between the pinion gear and the ring gear until the engine completely stops.

The starter according to the present invention provides the electromagnetic solenoid for pushing the pinion body outward in the axial direction and the motor switch that opens and closes the motor contact point. Since the operations of the electromagnetic solenoid and the electromagnetic switch can be controlled individually, when the engine is going to stop, the pinion gear can be meshed with the ring gear being rotate without use of the rotational force of the motor. Specifically, when the pinion body is pushed out to the axial direction by the operation of the electromagnetic solenoid, even when the end surface of the pinion gear comes into contact with the end surface of the ring gear, meshing is established between the pinion gear and the ring gear by rotating of the ring gear to a position allowing meshing with the pinion gear. As described above, the pinion gear meshes with the ring gear that is rotating and the meshing is subsequently maintained. Therefore, the ring gear additionally receives load of the inertial mass of the starter. As a result, the overshooting of the engine can be reduced whereby period of the engine-oscillation also can be reduced.

In the above-described starter, the control means is configured to control the electromagnetic switch to make the motor contact point kept open whereby the motor is not supplied the power by the power source while the meshing between the pinion gear and the ring gear is kept until the engine completely stops. The starter according to the present invention, the electromagnetic solenoid and the electromagnetic switch can be individually controlled. Therefore, when the electromagnetic solenoid pushes the pinion body outward in the axial direction, the magnetic switch does not operate together with the electromagnetic solenoid. In other words, while the pinion gear and the ring gear remain meshed after the electromagnetic solenoid makes the pinion gear mesh with the ring gear, the electromagnetic switch does not necessarily operate whereby the motor contact point is not closed. As a result, the motor does not generate the rotational force.

According to the above-described starter, the motor is configured as a commutator motor. The commutator motor includes: a commutator provided with an armature; a brush being contact with a surface of the commutator; and a brush spring pressing the brush against the surface of the commutator. The starter according to the present invention features that the pinion gear meshes with the ring gear that is rotating so that the pinion gear starts to rotate by the rotational force of the ring gear. Then the rotational force of the pinion gear is transmitted to the armature of the motor. As a result, the armature of the motor rotates. At the moment, in the motor (the commutator motor), a slide resistance is generated between the commutator surface and the brush 16 being pressed by the brush spring. The generated slide resistance works as a brake force to cause the rotation of the armature stops. Thus, the ring gear being meshed with the pinion gear 6 is influenced by the above-described brake force in addition to the inertia mass. Therefore, the engine-oscillation can be significantly suppressed.

According to the above-described starter, the motor is configured as a permanent-magnet field type commutator motor including a yoke provided with the motor; a permanent magnet arranged on an inner circumference of the yoke to form a field magnet; and an armature rotatably arranged on an inner circumference of the field magnet. When the motor is not powered (i.e., the armature is not energized), the magnetic field being generated by the permanent magnet induces force that allows the armature to stop the movement. Thus, the ring gear being meshed with the pinion gear is influenced by the above-described force in addition to the inertia mass. Therefore, the engine-oscillation can be significantly suppressed.

DESCRIPTION OF THE PREFERRED EMBODIMENTS

Hereinafter will be described preferred embodiments of the present invention in detail.

(First Embodiment)

Hereinafter will be described a first embodiment with reference to FIGS. 2 to 5.

Figure 1:
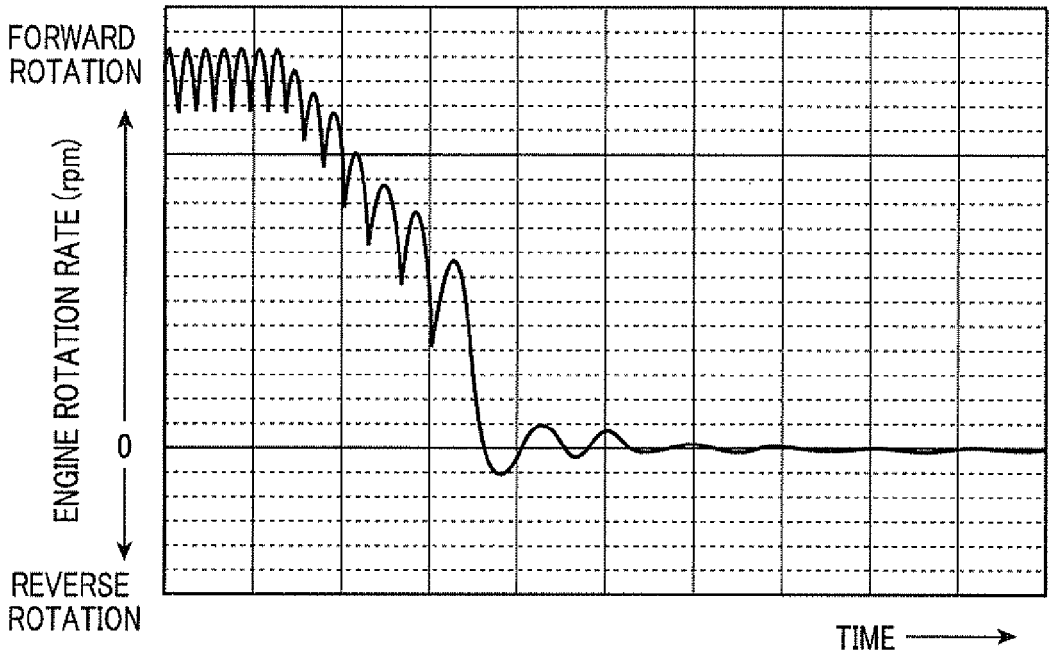
FIG.1 PRIOR ART
FIG. 1 is a graph showing engine rotation rate illustrating engine-oscillation when the engine is stopped according to prior art.
Figure 2:
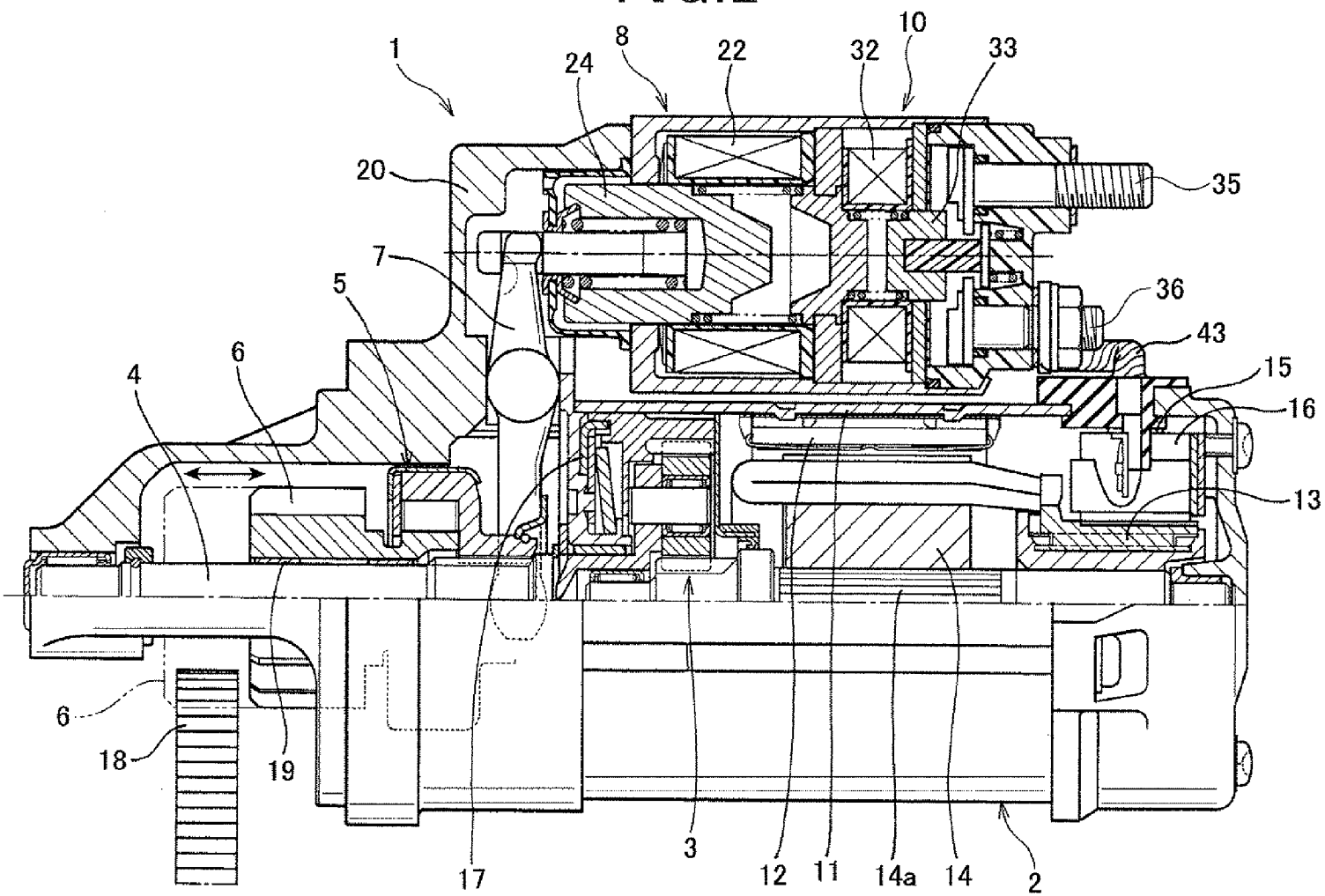
FIG. 2 is a half cross-sectional view showing an internal structure of the starter.

As shown in FIG. 2, a starter according to the embodiment includes a motor 2 that generates a rotational force, a reduction gear 3 that reduces the rotational force of the motor 2, output shaft 4 that is coupled to the output side of the reduction gear 3, a clutch 5 that is engaged to the outer circumference of the output shaft 4 by a helical spline, a pinion gear 6 provided such as to be allowed movement integrally with the clutch 5 in an axial direction along the outer circumference of the output shaft 4, an electromagnetic solenoid 8 that generates force for pushing the clutch 5 and the pinion gear 6 in a counter-motor direction (leftward direction in FIG. 2) via a shift lever 7, and an electromagnetic switch 10 that opens and closes a motor contact point (described hereafter) provided on a motor circuit for sending current from a battery 9 (see FIG. 4) to the motor 2. The battery 9 corresponds to the power source. The pinion gear 6 and the clutch 5 correspond to the pinion body.

The motor 2 is a permanent-magnet field type commutator motor that includes a field magnet in which a plurality of permanent magnet 12 is arranged on an inner circumference of a yoke 11, an armature 14 in which a commutator 13 is arranged on one end section of the armature shaft 14*a* and a brush 16 arranged on an outer circumference (referred to a commutator surface) of the commutator 13 with in contact. The brush 16 is pressed against a surface of the commutator by a brush spring 15. The reduction gear 3 is a known planetary gear, which combines a friction plate type shock-absorbing device. The shock-absorbing device absorbs excessive shock such that the friction plate of the shock-absorbing device slides (rotates) when the excessive shock occurs on the reduction gear 3 to absorb the excessive shock. The output shaft 4 is disposed on the same axis of the armature shaft 14*a* through the reduction gear 3. The rotational torque of the motor 2 is amplified by the reduction gear 3 and transmitted to the output shaft 4.

The clutch 5 is configured to transmit the rotational force of the output shaft 4 to the pinion gear 6 when the output shaft which is driven by the motor 2, starts to rotate. Also, the clutch 5 is configured to be a one-way clutch to cut off the power transmitted between the pinion gear 6 and the output shaft 4. Specifically, the clutch 5 cut off the power transmission to avoid transmitting the rotational force of the pinion gear 6 to the output shaft 4, when the pinion gear 6 is meshed with the ring gear 18 to be driven by the engine, that is, the rotation speed of the pinion gear 6 exceeds the rotation speed of the output shaft 4. The pinion gear 6 is disposed in a section of the counter-motor direction of the clutch 5 and disposed integrally with an inner section of the clutch 5. Moreover, the pinion gear 6 is rotatably supported by the outer circumference of the output shaft 4 via a bearing 19.

Figure 3:
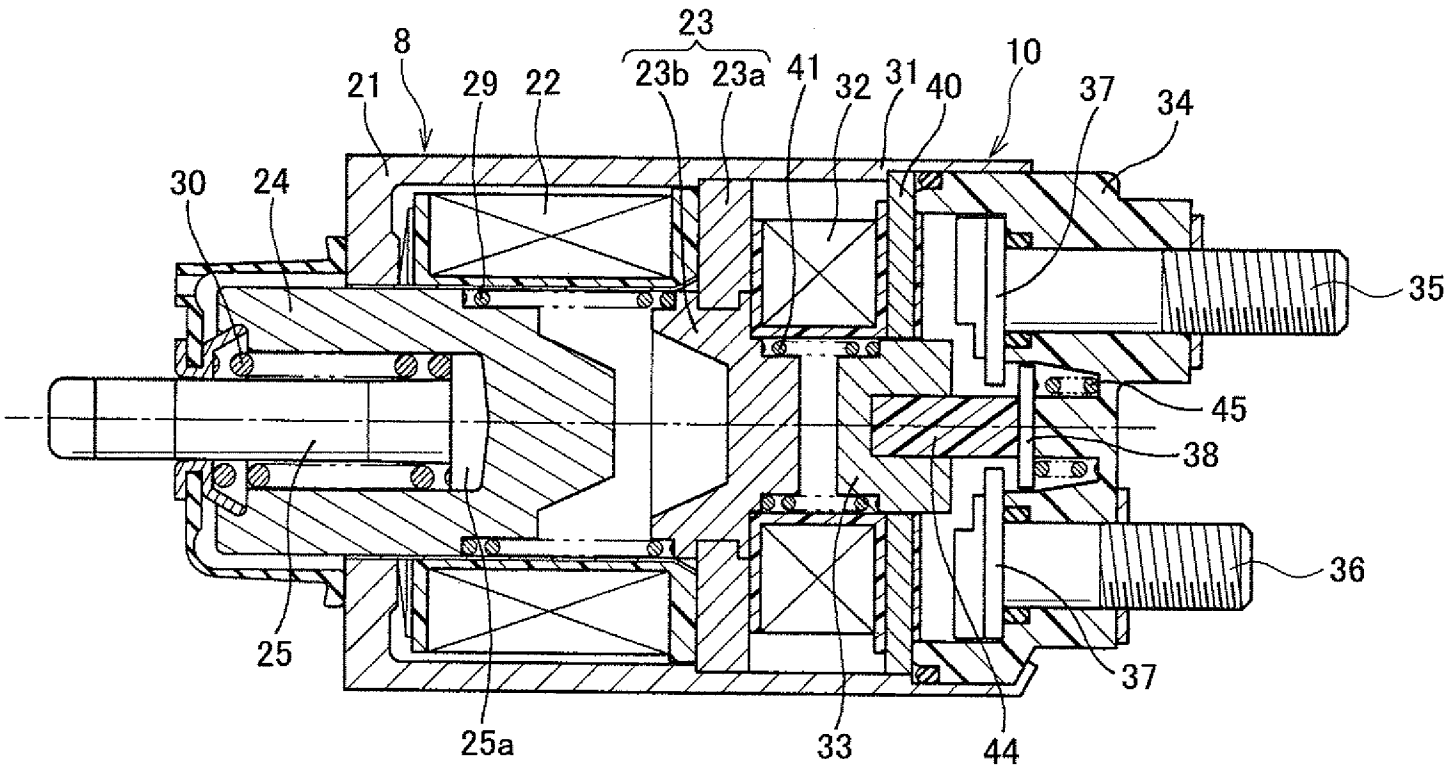
FIG. 3 is a cross-sectional view of the an electromagnetic solenoid and an electromagnetic switch.
Figure 4:
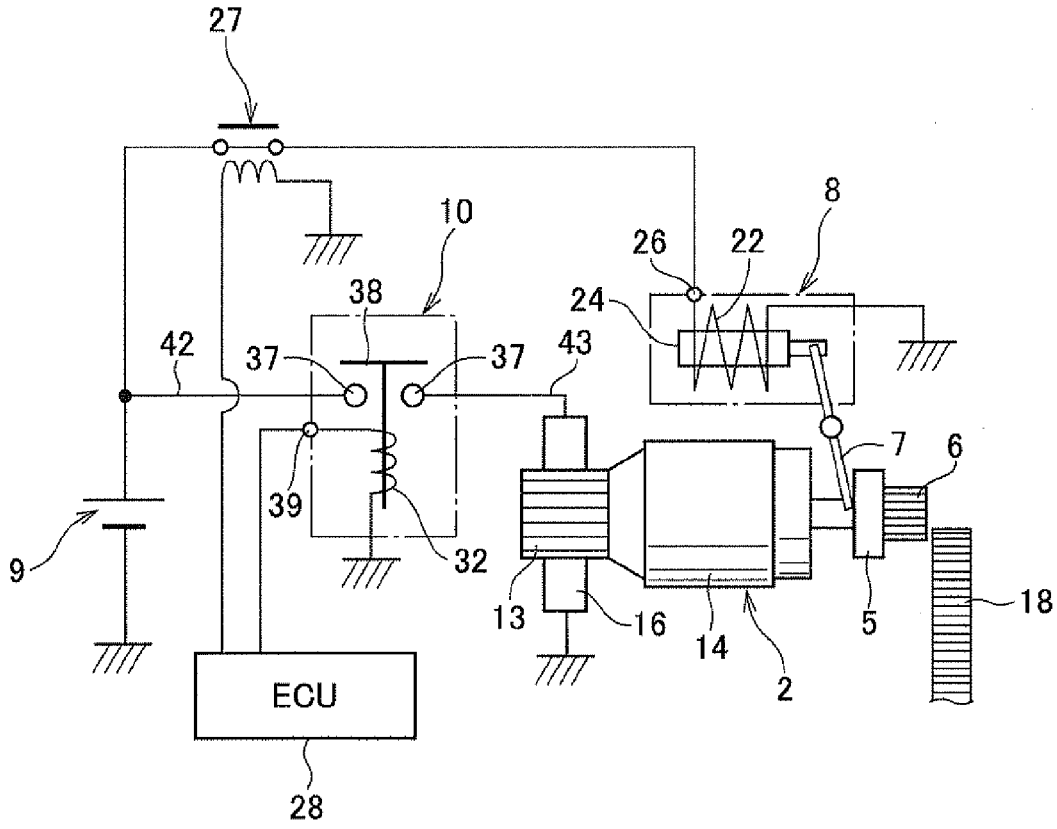
FIG. 4 is an electrical circuit diagram of a starter.

The electromagnetic solenoid 8 and the electromagnetic switch are integrated and fixed to the starter housing 20 in parallel with the motor 2. As shown in FIG. 3, the electromagnetic solenoid 8 comprises a solenoid case 21, a solenoid coil 22, a fixed core 23, a plunger 24, a joint 25 and the like. A solenoid coil 22 is accommodated in the inner section of the solenoid case 21, a fixed core 23 is magnetized by the solenoid coil 22 being energized, a plunger 24 is disposed facing the fixed core 23, the plunger 24 is movable towards the fixed core 23 and a joint 25 transmits the movement of the plunger 24 to the shift lever 7. As shown in FIG. 4, one end section of the solenoid coil 22 is connected to the connector terminal 26 and the other end section of the solenoid coil 22 is fixed on the surface of the fixed core 23 by welding or the like and is grounded. An electrical wiring leading to the starter relay 27 is connected to the connector terminal 26. The starter relay 27 is ON/OFF controlled by the ECU 28 (Electronic control unit) that controls the operation of the starter 1. The solenoid coil 22 is energized by the battery 9 via the starter relay 27 when the starter relay 27 is turned on. The ECU 28 corresponds to control means.

The fixed core 23 is configured divided into a disk-shaped plate section 23*a* and a core 23*b* fixed to the inner circumference of the plate section 23*a* by crimping. An outer circumferential end section of the plate section 23*a* on the coil side (left side in FIG. 3) in the plate thickness direction is in contact with a stepped section provided on the inner circumference of the solenoid case 21, restricting the position of the plate section 23*a* on the coil side. The plunger 24 is disposed such as to be allowed movement in the axial direction along the inner circumference of the solenoid coil 22 (left-right direction in FIG. 3). The plunger 24 is urged in a counter-core section direction (leftward direction in FIG. 3) by counter-force of a return spring 29 provided between the plunger 24 and the core section 23*b*. The plunger 24 is provided having a roughly cylindrical shape with a cylindrical hole in its radial-direction center. The cylindrical hole is open on one end side of the plunger 24 in the axial direction and has a bottom surface on the other end side in the axial direction.

The joint 25 is inserted into the cylindrical hole of the plunger 24 together with a drive spring 30 as described below. The joint 25 is rod-shaped and one end section of the shift lever 7 engages with the end section of one end side of the joint 25 that is protruded from the cylindrical hole of the plunger 24. A flange section 25*a* is provided on the end section of the other end side of the joint 25. The flange section 25*a* has an outer diameter that allows the flange section 25*a* to slide against the inner circumference of the cylindrical hole. The flange section 25*a* receives load from the drive spring 30 and is pressed against the bottom surface of the cylindrical hole. After the end surface of the pinion gear 6 pushed outward in the counter-motor direction via the shift lever 7 comes into contact with the end surface of ring gear 18 as a result of the movement of the plunger 24, the drive spring 30 is compressed while the plunger 24 moves until the plunger 24 adheres to the core section 23*b*. The drive spring 30 stores reactive force for meshing the pinion gear 6 with the ring gear 18.

As shown in FIG. 3, the electromagnetic switch 10 shares the fixed core 23 with the electromagnetic solenoid 8. In addition to the fixed core 23, the electromagnetic switch 10 is configured by a cylindrical switch yoke 31, a switch coil 32, a movable core 33, a resin contact point cover 34, two terminal bolts 35 and 36, a pair of fixed contact points 37 and a movable contact point 38, and the like. The switch yoke 31 is provided integrally with the solenoid case 21 in a manner in which the opening section side of the solenoid case 21 extends in the axial direction. The switch coil 32 is disposed on the inner circumference of the switch yoke 31. The movable core 33 is disposed facing the fixed core 23 and is movable towards the fixed core 23. The contact point cover 34 is assembled such as to cover an opening section of the switch yoke 31. The two terminal bolts 35 and 36 are fixed to the contact point cover 34. The pair of fixed contact points 37 is connected to the motor circuit by the two terminal bolts 35 and 36. The movable contact point 38 provides intermittent electrical connection between the pair of fixed contact points 37.

The switch coil 32 is disposed in the inner circumference of the switch yoke 31 further outward (right side in FIG. 3) than the plate section 23*a* of the fixed core 23. In other words, the solenoid coil 22 is disposed on one end side in the axial direction and the switch coil 32 is disposed on the other end side in the axial direction with the plate section 23*a* therebetween. As shown in FIG. 4, one end section of the switch coil 32 is connected to an external terminal 39. The other end section is, for example, fixed to the surface of the fixed core 23 by welding or the like and grounded. The external terminal 39 is provided such as to project further outward than the end surface of the connection point cover 34. An electrical wire leading to the ECU 28 is connected to the external terminal 39. A disk-shaped magnetic plate 40 forming a section of a magnetic circuit is disposed on the counter-plate section side of the switch coil 32. The outer circumferential end section of the magnetic plate 40 on the coil side (left side in FIG. 3) is in contact with a stepped section provided on the inner circumference of the switch yoke 31, restricting the position of the coil side. The movable core 33 is disposed such as to be allowed movement in the axial direction along the inner circumferences of the magnetic plate 40 and the switch coil 32. The movable core 33 is urged in a counter-core section direction (rightward direction in FIG. 3) by a return spring 41 provided between the movable contact 33 and the core section 23*b*.

The contact point cover 34 has a cylindrical leg section. The leg section is inserted into the inner side of the switch yoke 31 and disposed such that the end surface of the leg section is in contact with the surface of the magnetic plate 40. The contact point cover 34 is fixed to the switch yoke 31 by crimping. The two terminal bolts 35 and 36 are, respectively, a B terminal bolt 35 to which a battery cable 42 is connected (see FIG. 4) and an M terminal bolt 36 to which a motor lead wire 43 is connected (see FIG. 2 and FIG. 4). The pair of fixed contact points 37 is provided separately from (or integrally with) the two terminal bolts 35 and 36, and is electrically connected to the two terminal bolts 35 and 36 on the inner side of the contact point cover 34. The battery cable 42 and the motor lead wire 43 correspond to the power line.

The movable contact point 38 is disposed further to the counter-movable core side (right side in FIG. 3) than the pair of fixed contact points 37. The movable contact point 38 receives load from a contact point pressure spring 45 and is pressed against an end surface of a resin rod 44 fixed to the movable core 33. However, an initial load of the return spring 41 is set to be greater than an initial load of the contact point pressure spring 45. Therefore, when the switch coil 32 is not energized, the movable contact point 38 sits on an internal seating surface of the contact point cover 34 in a state in which the contact point pressure spring 45 is compressed. Motor contact points are formed by the pair of fixed contact points 37 and the movable contact point 38. The motor contact points are in a closed state when force is applied to the movable contact point 38 by the contact point pressure spring 45 and the movable contact point 38 is in contact with the pair of fixed contact points 37 with sufficient pressing force, allowing conduction between the two fixed contact points 37.

The motor contact points are in an open state when the movable contact point 38 moves away from the pair of fixed contact points 37, blocking conduction between the two fixed contact points 37.

Next, operations of the starter 1 will be described. When the idle-stop is performed or the driver turns off the ignition-switch to stop the engine, The ECU 28 closes the starter relay 27 during the ring gear 18 is rotating (lower than idling rotation speed, e.g. less than 300 rpm) and the solenoid coil 22 is energized (refer to FIG. 5). Therefore, the plunger 24 is suctioned to the magnetized core section 23*b* so that the pinion gear 6 is pushed outward in the counter-motor direction integrally with the clutch 5, via the shift lever 7. At this point, the motor contact points remain open whereby the motor is not energized. Here, even when the end surface of the pinion gear 6 comes into contact with the end surface of the ring gear 18, because the ring gear 18 is rotating at a low speed, the pinion gear 6 is pressed outward by the reactive force stored in the drive spring 30 when the ring gear 18 rotates to a position allowing meshing with the pinion gear 6. Meshing is established between the pinion gear 6 and the ring gear 18. Hereinafter a term "pinion preset" will be used. The pinion preset is making the pinion gear 6 meshed with the ring gear 18 while the engine is in the process of stop, which is established by allowing the electromagnetic solenoid 8 to operate during the ring gear 18 is rotating.

Figure 5:
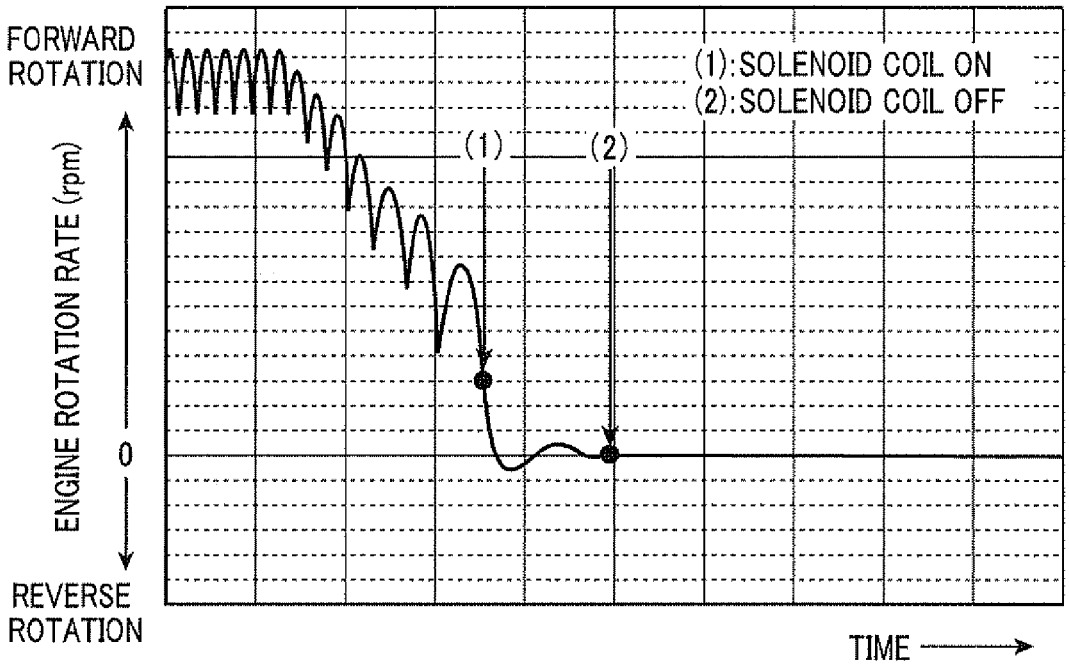
FIG. 5 is a graph showing an engine rotation rate illustrating engine-oscillation when the engine is stopped according to first is embodiment.
Figure 6:
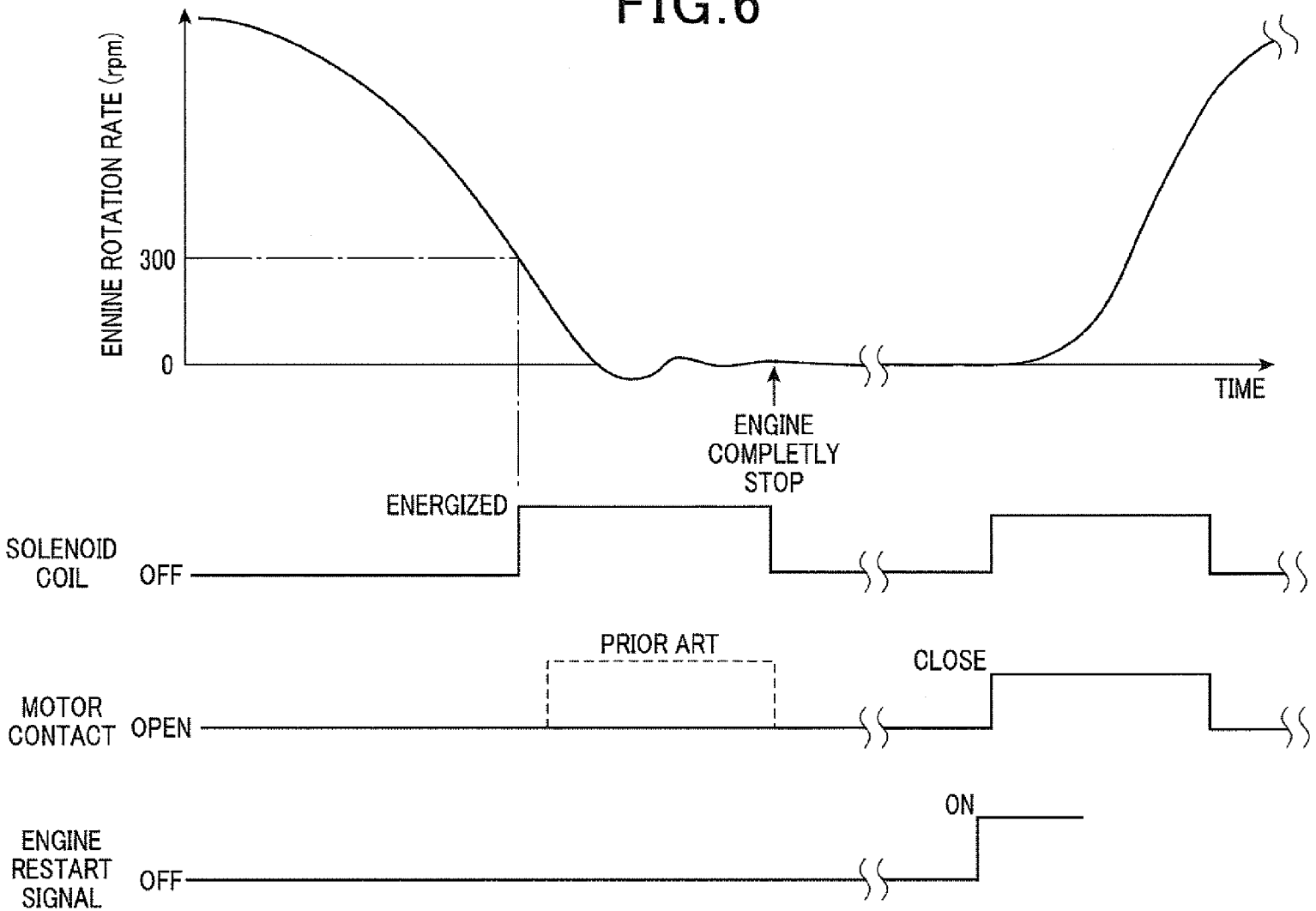
FIG. 6 is a timing diagram illustrating an operation of a starter.

Subsequently, when the rotation of the engine completely stops, the ECU 28 opens the starter relay 27 whereby energizing to the solenoid coil 22 is stopped (refer to FIG. 5). At the moment, a force returning the clutch 5 to the armature 14 side via the shift lever 7 is applied because the plunger 24 tries to return as a result of the reactive force of the return spring 29. On the other hand, because the clutch 5 is engaged with the outer circumference of the output shaft 4 by the helical spline, when a torsional angle of the helical spline is set to be large to a certain extent, the clutch 5 can be prevented from returned because movement resistance generated when the clutch 5 moves along the outer circumference of the outer shaft 4 along the helical spline increases. As a result, the pinion gear 6 and the ring gear 18 remain meshed.

(Effects According to the First Embodiment)

In the starter 1 according to the first embodiment, pushing the pinion gear 6 towards the ring gear 18 side, and opening and closing the motor contact points can be performed by separate means (the electromagnetic solenoid 8 and the electromagnetic switch 10). Both means can be separately and independently controlled. Therefore, when the engine is going to stop, the pinion preset can be performed without use of the rotational force of the motor 2 (i.e., without operating the electromagnetic switch 10). Also, the pinion gear 6 and the ring gear 18 remain meshed until the engine stops. In particular, because the solenoid coil 22 is energized when the rotation speed of the ring gear 18 is within a range that is a predetermined rotation speed (such as 300 rpm) or less, the predetermined rotation speed being lower than the idling engine speed, the pinion gear 6 can be meshed with the ring gear 18 with certainty.

As described above, before the engine starts the swinging, the pinion preset is performed whereby the meshed state between the pinion gear 6 and the ring gear 18 is maintained until the engine stops. Hence, the ring gear 18 receives load of the inertial mass of the starter 1 so that the overshooting of the engine can be reduced. In addition, duration of the swinging can be shortened. According to the experiment result, duration of the engine-oscillation without performing the pinion preset is 0.9 second, however, when the pinion preset is performed, duration of the engine-oscillation is reduced to 500 millisecond. Finally, the vibration caused by the engine-oscillation when the engine is stopping can be significantly improved. Therefore, discomfort of the driver can be removed.

Moreover, since the pinion gear 6 meshes with the ring gear 18 during inertial rotation of the ring gear 18, the pinion gear 6 is rotated by the rotational force of the ring gear 18 and the rotational force of the pinion gear 6 is transmitted to the armature shaft 14a of the motor 2 whereby the armature 14 start to rotate. At the moment, in the motor 2, a slide resistance is generated between the commutator surface and the brush 16 being pressed by the brush spring 15. As a result, the generated slide resistance works as a brake force to cause the rotation of the armature 14 stops. The electromagnetic switch 10 does not operate while the pinion gear 6 and the ring gear 18 remain meshed. In other words, since the motor 2 is not powered (i.e., the armature 14 is not energized), the magnetic field being generated by the permanent magnet 12 induces force that allows the armature 14 to stop the movement. Thus, the ring gear 18 being meshed with the pinion gear 6 is influenced by the above-described brake force and the force to stop the movement in addition to the inertia mass. Therefore, the engine-oscillation can be significantly suppressed.

(Modification)

The starter 1 according to the first embodiment, the electromagnetic solenoid 8 and the electromagnetic switch 10 is integrally provided. However, these components can be separately provided. When the electromagnetic solenoid and the electromagnetic switch are configured separately, the electromagnetic switch 8 can be configured using various components used for magnetic switches as before e.g. a magnetic switch disclose in the above-described patent document, Japanese Patent Laid-open Publication No. 2008-163818. Also, versatile electromagnetic switches can be used for the electromagnetic switch 10 so that the manufacturing cost can be reduced.

What is claimed is:

1. A starter to start an engine mounted on a vehicle comprising:

a motor that generates rotational force by supplying power supplied by a power source via a power line;

an output shaft that rotates by receiving the rotational force transmitted by the motor;

a pinion gear that transmits the rotational force generated by the motor to a ring gear;

a pinion body being allowed to move integrally with the pinion gear in an axial direction along an outer circumference of the output shaft;

an electromagnetic solenoid that generates force to push the pinion body outward in the axial direction towards the ring gear side;

an electromagnetic switch for switching a motor contact point disposed in the power line, on and off to control supplying the power to the motor; and a control means configured to control the electromagnetic solenoid and the electromagnetic switch individually, wherein the control means: (i) controls the electromagnetic solenoid and the electromagnetic switch to allow the pinion body to move in the axial direction towards the ring gear side when the engine is stopping and a rotation speed of the ring gear is lower than a predetermined rotation speed whereby the pinion gear meshes with the ring gear during an inertial rotation of the ring gear, (ii) controls the electromagnetic solenoid and the electromagnetic switch to hold the movement of the pinion body so as to keep the meshing between the pinion gear and the ring gear until the engine completely stops, and (iii) controls the electromagnetic switch to keep the motor contact point open whereby the motor is not supplied the power by the power source while the meshing between the pinion gear and the ring gear is kept until the engine completely stops.

2. The starter according to claim 1, wherein the motor is configured as a commutator motor, the motor further comprising:

a commutator provided with an armature;

a brush being contact with a surface of the commutator; and a brush spring pressing the brush against the surface of the commutator.

3. The starter according to claim 1, wherein the motor is configured as a permanent-magnet field type commutator motor, the motor further comprising:

a yoke provided with the motor;

a permanent magnet arranged on an inner circumference of the yoke to form a field magnet; and an armature rotatably arranged on an inner circumference of the field magnet.

4. The starter according to claim 2, wherein the motor is configured as a permanent-magnet field type commutator motor, the motor further comprising:

a yoke provided with the motor;

a permanent magnet arranged on an inner circumference of the yoke to form a field magnet; and an armature rotatably arranged on an inner circumference of the field magnet.

5. The starter according to claim 1, wherein the control means is configured to control the electromagnetic switch to keep the motor contact point open before the pinion gear meshes with the ring gear while the engine is stopping.

* * * * *